US006670000B1

(12) United States Patent
Misuda et al.

(10) Patent No.: US 6,670,000 B1
(45) **Date of Patent: *Dec. 30, 2003**

(54) RECORDING MEDIUM, INK-JET RECORDING THEREWITH, AND PROCESS FOR PRODUCTION THEREOF

(75) Inventors: Katsutoshi Misuda, Yokohama (JP); Nobuyuki Hosoi, Kazo (JP); Kenji Shinjo, Kawasaki (JP); Ako Omata, Kawasaki (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 143 days.

(21) Appl. No.: 09/025,705

(22) Filed: Feb. 18, 1998

(30) Foreign Application Priority Data

Feb. 18, 1997 (JP) ..... 9-033814
Apr. 24, 1997 (JP) ..... 9-107343
Apr. 24, 1997 (JP) ..... 9-107350

(51) Int. Cl.[7] ..... B41M 5/00; B41J 2/01; B05D 5/04

(52) U.S. Cl. ..... 428/32.1; 347/105; 427/375; 428/32.23; 428/32.25; 428/32.34

(58) Field of Search ..... 428/195, 327, 428/328, 329, 522, 32.1, 32.23, 32.25, 32.34; 427/375; 347/105

(56) References Cited

U.S. PATENT DOCUMENTS

| | | | | |
|---|---|---|---|---|
| 4,242,271 A | | 12/1980 | Weber et al. | 260/448 AD |
| 4,778,711 A | | 10/1988 | Hosomura et al. | 428/211 |
| 5,254,403 A | * | 10/1993 | Malhotra | 428/32.3 |
| 5,374,475 A | | 12/1994 | Wälchli | 428/304.4 |

FOREIGN PATENT DOCUMENTS

| | | |
|---|---|---|
| EP | 575644 A1 | 12/1993 |
| EP | 583141 A2 | 2/1994 |
| GB | 2166558 | 5/1986 |
| JP | 59-22683 | 2/1984 |
| JP | 59-222381 | 12/1984 |
| JP | 6-55870 | 3/1994 |
| JP | 7-237348 | 9/1995 |
| JP | 8-2090 | 1/1996 |

OTHER PUBLICATIONS

Database WPI, Derwent Publications Ltd., Class A97, AN 96–093304, (with respect to JP 8–2090 of Jan. 9, 1996).

S. Muroi, "Chemistry of High Polymer Latices", Kobunshi Kankokai, K.K., Mar. 15, 1986, pp. 260–261, with partial translation.

* cited by examiner

*Primary Examiner*—Pamela R. Schwartz
(74) *Attorney, Agent, or Firm*—Fitzpatrick, Cella, Harper & Scinto

(57) ABSTRACT

A recording medium comprises a porous outermost layer on a substrate, the porous outermost layer containing a particulate thermoplastic resin, and the particulate thermoplastic resin exhibiting a ΔE value of not higher than 20 after light exposure. The difference of glass transition temperature of the particulate thermoplastic resin from minimum film-forming temperature thereof may be not less than 10° C., and the minimum film-forming temperature is not lower than 50° C.

A process for producing the recording medium comprises forming a porous outermost layer by heat treatment at a temperature of not lower than the glass transition temperature of the particulate thermoplastic resin, but not higher than the minimum film-forming temperature thereof.

7 Claims, 1 Drawing Sheet

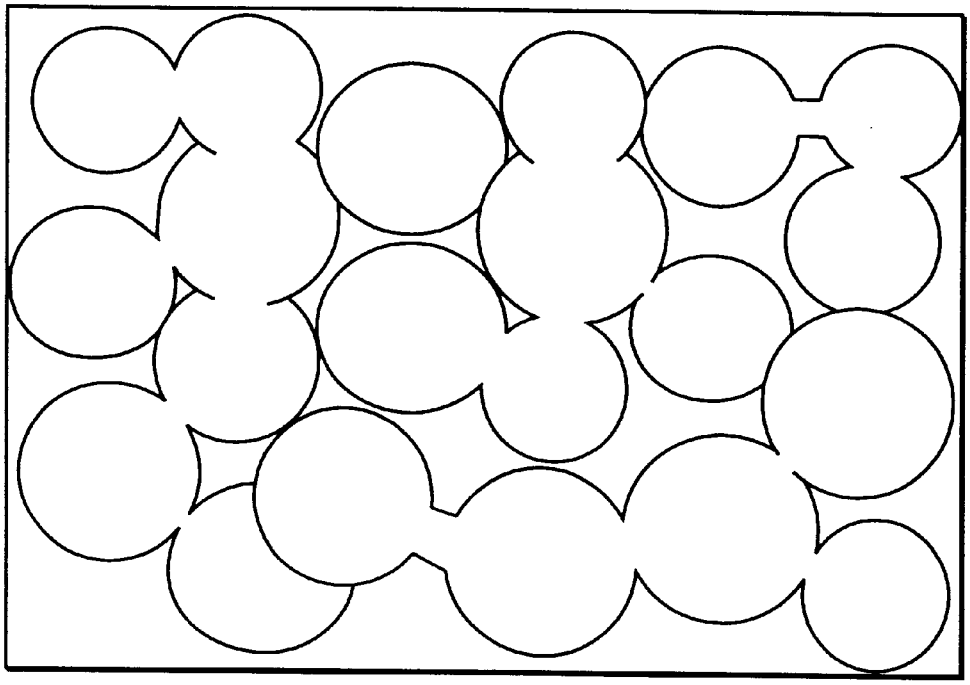

RECORDING MEDIUM, INK-JET RECORDING THEREWITH, AND PROCESS FOR PRODUCTION THEREOF

BACKGROUND OF THE INVENTION

1. Field of the Invention

The present invention relates to a recording medium for ink-jet recording, an ink-jet recording method employing the recording medium, and a process for producing the recording medium.

2. Related Background Art

The ink-jet recording system records pictures and letters by discharging fine ink droplets through a nozzle onto a recording medium such as a paper sheet. The ink-jet recording system is characterized by high-speed recording with less noise generation, ease of multicolor recording, needlessness of image development, and other features. The ink-jet recording system is rapidly becoming used widely not only for printers but for information apparatuses such as copying machines, word-processors, facsimile machines, and plotters.

In recent years, digital cameras, digital videos, and scanners have become supplied at low prices, and personal computers have become widely used. As a result, ink-jet recording apparatuses have become widely employed for outputting the picture image information. Therefore, demands have been placed on the ink-jet system output images of high quality, like silver salt type photographs and multicolor gravure prints.

The recording apparatus and the recording system are being improved for higher recording speed. Correspondingly image formation, and full color printing. Correspondingly the recording medium is required to have higher performances.

Under such circumstances, the recording medium is generally required to have the properties below:

(1) high ink-absorption rate with minimum running of the ink, (2) high density printing with high color development, (3) high weatherability, (4) formation of glossy images, and so forth.

Various proposals have been presented to meet such requirements. For example, Japanese Patent Laid-Open No. 59-22683 discloses crack formation on the surface of a printing sheet to improve ink absorption and image gloss, by applying two kinds or more of thermoplastic resin having different minimum film-forming temperatures onto the substrate surface and drying it to form a film.

Japanese Patent Laid-Open Nos. 59-222381, 6-55870, 7-237348, and 8-2090 disclose a thermoplastic resin particle layer formed on the surface of a pigment layer which is transformed into a film after printing.

However, known thermoplastic resins are generally liable to be discolored by exposure to light, and are not suitable for long term storage of the recording sheets or the printed matters.

Furthermore, some kinds of thermoplastic resins have disadvantages in that they do not form a porous layer of desired properties. This causes problems of a low ink absorption rate, extremely small diameter of printed dots causing a white blank of images, insufficient adhesion of the particles to the lower layer or between particles to cause insufficient resistance against scratching, decrease of gloss or deterioration of weatherability on heating for non-porosity, and so forth.

SUMMARY OF THE INVENTION

An object of the present invention is to provide a novel recording medium which does not have the aforementioned problems, such as the recording medium not causing discoloration of the recording medium and printed matter, and which forms a printed matter with high ink absorbency and image density.

Another object of the present invention is to provide a process for producing the above novel recording medium.

A further object of the present invention is to provide an ink-jet recording method employing the above recording medium.

The recording medium of the present invention comprises a porous outermost layer on a substrate containing a particulate thermoplastic resin, and the resin exhibiting a ΔE value of not higher than 20 after light exposure.

The recording method of the present invention comprises allowing ink droplets to fly onto the above recording medium to adhere thereon, and subsequently heating the recording medium as necessary.

The process for producing the recording medium of the present invention comprises forming a porous outermost layer by heat treatment at a temperature not lower than the glass transition temperature but not higher than the minimum film-forming temperature of the particulate thermoplastic resin.

BRIEF DESCRIPTION OF THE DRAWING

FIGURE is an enlarged view showing a partial fusion state of the outermost layer in the present invention.

DESCRIPTION OF THE PREFERRED EMBODIMENTS

The present invention is described below in detail.

The recording medium of the present invention comprises a porous layer containing a particulate thermoplastic resin as the outermost layer. The applied ink penetrates through the porous layer onto an underlying layer such as an ink-receiving layer and an ink-absorbent substrate to form an image. The outermost layer is then made nonporous, to obtain a printed matter with high image density and high weatherability.

In the present invention, the recording medium is formed using a porous layer containing a particulate thermoplastic resin of a ΔE not higher than 20, whereby the obtained recording medium is less liable to be discolored even after long-term storage and has high ink permeability.

The ΔE value, which is an index of the degree of photo-deterioration of a resin, is a color difference caused by light exposure. In the present invention, the value of ΔE of a thermoplastic resin is derived by exposing the resin to light (wavelength of 340 nm, dose of 0.39 $W/m^2$) with a xenon fadeometer under the conditions of temperature of 63° C. and humidity of 70% for 200 hours, measuring the color differences before and after light exposure with a color difference meter CMS-500 (manufactured by Murakami Sikisai K. K.) according to JIS Z 8730, and calculating according to the equation below:

$$\Delta E=[(L-L_0)^2+(a-a_0)^2+(b-b_0)^2]^{1/2}$$

where L, $L_0$, a, $a_0$, b, and $b_0$ are as defined in JIS Z 8729: L and $L_0$ are levels of the lightness; a and $a_0$ are levels of the hue; b and $b_0$ are levels of the saturation; $L_0$, $a_0$, and $b_0$ are measured values before the light exposure; and L, a, and b are measured values after the 200-hour exposure.

Any kind of particulate thermoplastic resin may be used in the present invention provided that it has the aforementioned properties, including materials of the following types: vinyl chloride, vinylidene chloride, styrene, acrylate, urethane, polyester, and ethylene; latexes of the vinyl chloride-vinyl acetate, vinyl chloride-acrylate, vinyl chloride-vinylidene chloride, vinylidene chloride-acrylate, SBR, and NBR types; mixtures of latexes of the above copolymers such as SBR/NBR, and vinyl chloride-acrylate/vinyl acetate.

The thermoplastic resin having a conjugated double bond component like an aromatic compound in the resin-constituting polymer units tends to exhibit UV transmittance of less than 80%, causing photo-deterioration. Therefore, the thermoplastic resin contains preferably a component not being a conjugated double bond at a content of 50% or higher, more preferably 70% or higher.

The use of a thermoplastic resin is preferred which exhibits, after it is made nonporous, UV transmittance of not lower than 85%, or more preferably not lower than 90% for higher long-term storability of the recording medium.

The thermoplastic resin generally changes its states with temperature. The resin having a high elasticity modulus at a lower temperature becomes rubbery abruptly at about the glass transition temperature. Most of thermoplastic resins begin film formation near the glass transition temperature (Tg). With further temperature elevation, the resin changes its elasticity modulus abruptly to become flowable (at flow temperature). Most of thermoplastic resins have the minimum film-forming temperature (MFT) nearly equal to Tg. In the present invention, the MFT was measured by the temperature gradient plate method reported by Protzman, et al. described in S. Muroi: "*CHEMISTRY OF HIGH POLYMER LATICES*", Kobunshi Kankokai K. K. 1986 March 15 (10th impression), pp 260–261.

The physical properties of the thermoplastic resin, including strength, softening temperature, and flow temperature thereof, depend mainly on the intermolecular force. A polymer of higher crystallinity does not soften above Tg, and the MFT coincides with the flow temperature. Such a polymer which does not form a film at a temperature above the Tg is suitable for forming a porous layer having higher ink permeability.

The particulate thermoplastic resin for the outermost layer of the present invention preferably has a minimum film-forming temperature (MFT) of 50° C. or higher for ease of formation of a porous layer containing a thermoplastic resin. The particulate thermoplastic resin preferably has a minimum film-forming temperature (MFT) higher by 10° C. or more than the glass transition temperature (Tg), more preferably by 20° C. or more, still more preferably by 30° C. for ease of the heat treatment. On the other hand, the particulate thermoplastic resin preferably has a minimum film-forming temperature (MFT) not higher than 150° C. for ease of non-porosity treatment after printing.

The fine particulate thermoplastic resin having the aforementioned properties, particularly the ones having higher crystallinity, are preferred in the present invention. Since the ones having an extremely high crystallinity have an extremely high minimum film-forming temperature, the polymers having the properties intermediate between a crystalline polymer and an amorphous polymer are more preferably used.

Further considering the long-term storability, the scratch resistance, and weatherability after the non-porosity treatment, thermoplastic resins that are preferred contain a vinyl chloride polymer or copolymer excellent in film mechanical strength, resistance against water, acid, alkali, oil, and organic solvent, and other properties.

More preferred are thermoplastic resins comprising a copolymer of the vinyl chloride monomer and one or more other monomers. The resin constituted of the vinyl chloride homopolymer has a certain regularity in the molecular arrangement, and forms very hard film. By copolymerizing vinyl chloride with one or more other monomers, the resin can be plasticized to lower the Tg and the temperature of non-porosity treatment of the thermoplastic resin.

At least one of the other comonomers for the copolymerization is preferably an ester of an unsaturated carboxylic acid such as acrylate ester, or a vinyl ester of a fatty acid. More preferably, one of the other comonomers is vinyl acetate in consideration of the uniform copolymerization and the ease of handling. For example, particularly preferred are latexes comprising a vinyl chloride-vinyl acetate type of copolymer having two or more kinds of monomer units.

It is desirable that the latex be stable in the emulsion state, to give improved adhesion between latex particles in the porous layer and between the porous layer and the underlying layer, to have suitably high affinity to the ink for improved ink permeability, and to be treatable at a lower temperature for non-porosity. To satisfy the above requirements, the latex used is preferably a copolymer of three or more kinds of monomers constituted of at least one vinyl chloride monomer, at least one of acrylate esters or fatty acid esters, and at least one monomer having a carboxyl group. Particularly preferred are latexes constituted of vinyl chloride-vinyl acetate-acrylate types of copolymers containing three or more kinds of monomers.

The porous layer containing particles of a thermoplastic resin should have a certain mechanical strength so as not to be readily separated from the substrate or a pigment layer formed thereon, and preferably the particles are partially fusion-bonded together to improve the adhesiveness (resistance against scratching) of the porous layer. The fusion-bonding is conducted by heat treatment at a temperature above the glass transition temperature (Tg) but below the minimum film-forming temperature. A slight amount of a binder such as polyvinyl alcohol may be added thereto to facilitate the fusion-bonding. The temperature of the fusion-bonding is preferably higher than the glass transition temperature by 10° C. or more, more preferably by 20° C. or more, still more preferably by 40° C. In the case where two or more kinds of particulate thermoplastic resins are employed, the glass transition temperature herein means the lowest one of the glass transition temperatures of the thermoplastic resins employed.

In the partially fusion-bonded state of the thermoplastic resin particles in the present invention, at least two of the adjacent particles are fused by heating to be bonded in a dumbbell form as illustrated in FIGURE. In the state of the bonding between the thermoplastic resin particles, the sectional bonding area is in the range preferably from $\pi r^2/400$ to $\pi r^2$, more preferably from $\pi r^2/200$ to $\pi r^2/4$.

The porous layer containing the thermoplastic resin has surface voids in a surface void ratio ranging preferably from 10% to 50%, more preferably from 20% to 40%, for obtaining sufficient ink absorbency and scratch resistance. The surface void volume ratio herein means a ratio of the void area on the porous surface layer. This ratio is derived by taking SEM photograph (magnification range: 10000 to 50000) of the surface of the porous layer containing the thermoplastic resin, inputting it into a personal computer as a digital image, and calculating the ratio of the void area to the displayed image area.

For the higher mechanical strength, a method is known in which two or more kinds of latexes having different minimum film-forming temperatures are mixedly used. In this method, cracking is liable to occur in the porous layer, and the after-effects thereof tend to appear after the non-porosity treatment, such as heating, with the weatherability or the migration unimproved.

For improving the ink absorption rate and for obtaining an appropriate print dot diameter, it is important to adjust the average particle diameter and the particle diameter distribution of the thermoplastic resin particles. The particles of the thermoplastic resin preferably have an average particle diameter ranging from 0.1 to 5.0 $\mu$m. The particles of 0.1 to 5.0 $\mu$m diameter are distributed preferably within $3\sigma$ ($\sigma$: standard deviation), and the content of the particles of smaller than one-fifth the average particle diameter is not higher than 10%. With a distribution of larger than $3\sigma$, or the ratio of the particles of smaller than one-fifth the average particle diameter of higher than 10%, the smaller particles tend to be packed closely around the larger particles to fill the voids, lowering the ink absorbency and the image quality.

The average particle diameter is in the range preferably from 0.1 to 3 $\mu$m, more preferably from 0.2 to 2 $\mu$m, still more preferably from 0.2 to 0.8 $\mu$m. With particles of an average particle diameter of less than 0.1 $\mu$m, the absolute void volume in the thermoplastic resin layer is smaller, and the resin begins to soften even at about the temperature of Tg and tends to fill the voids, lowering the ink absorbency and image quality. With an particles of the average diameter of more than 5 $\mu$m, the surface tends not to be flattened, causing lower gloss.

The porous layer containing the particulate thermoplastic resin may contain a UV absorbing agent. The UV absorbing agent further retards the discoloration of the image formed with the ink as well as the discoloration of the thermoplastic resin desirably.

The porous layer containing the particulate thermoplastic resin is obtained by applying a paint containing the particulate thermoplastic resin at a solid content ranging from 10% to 50% by weight onto a substrate or a pigment layer formed thereon, and heat-treating it preferably at a temperature of not lower than Tg but not higher than MFT of the thermoplastic resin.

The amount of coating of the particulate thermoplastic resin is preferably in the range of from 2 to 10 $\mu$m to obtain surface gloss by treatment after the printing, to prevent development of the interference color, and to serve as a protection layer.

The substrate useful in the present invention may be either transparent or opaque, including paper sheets such as wood free paper, medium quality paper, art paper, bond paper, resin-coated paper, and baryta paper; plastic films composed such as of polyethylene terephthalate, diacetate, triacetate, polycarbonate, polyethylene, and polyacrylate. When the ink-receiving layer is constituted only of a porous layer containing the particulate thermoplastic resin, the substrate is preferably selected from ink-absorbent paper or porous resins.

The paper sheet used as the substrate is coated with barium sulfate on the surface constituted of a fibrous material to obtain preferably Bekk smoothness of the surface of 400 seconds or higher and whiteness of 87% or higher to obtain an image comparable with a silver salt photograph.

The barium sulfate employed therefor has preferably an average particle diameter ranging from 0.4 to 1.0 $\mu$m, more preferably from 0.4 to 0.8 $\mu$m. Use of the barium sulfate having the particle diameter within such a range can satisfy the requirements for whiteness, gloss, and ink absorbency.

A binder suitable for binding the barium sulfate is gelatin, which is used in an amount ranging from 6 to 12 parts by weight based on 100 parts by weight of barium sulfate.

The barium sulfate is used for coating a substrate paper sheet in an amount ranging preferably from 20 to 40 g/m$^2$ for achieving absorption of the ink solvent and surface smoothness. The smoothness of the barium sulfate layer is preferably not higher than 600 seconds, more preferably not higher than 500 seconds since the higher layer smoothness tends to lower the ink absorbency.

In a preferred embodiment of the present invention, an ink-receiving layer containing a pigment is provided as the underlying layer for the outermost layer. The ink-receiving layer is provided to absorb and retain the ink applied to the outermost layer to form an image, and is a porous layer constituted mainly of a pigment.

The pigment employed includes silica, calcium carbonate, and alumina hydrate. Of these pigments, alumina hydrate is especially preferred in view of the dye-fixation and transparency.

The alumina hydrate can be produced by known methods such as hydrolysis of aluminum alkoxide, and hydrolysis of sodium aluminate. The alumina hydrate may be in a shape of ciliums, needles, plates, or spindles, but is not limited thereto, and may be either oriented or not oriented.

The alumina hydrate used in the present invention may be a commercial product or a fabrication product derived therefrom. The alumina hydrate desirably has high transparency, high gloss, high dye-fixability, and high coating properties without causing cracking of the film. Examples of the commercial product include "AS-2" and "AS-3" produced by Catalysts & Chemicals Industries Co., Ltd., "520" produced by Nissan Chemical Industries, Ltd.

The alumina hydrate is usually in a state of fine particles having particle diameter of not more than 1 $\mu$m, and has high dispersibility. Therefore, the alumina hydrate gives excellent smoothness and gloss to the recording medium.

The binder for binding the alumina hydrate is selected, as desired, from water-soluble polymers. The water-soluble polymers include polyvinyl alcohol and derivatives thereof; starch and derivatives thereof; gelatin and derivative thereof; casein and derivative thereof; gum arabic; cellulose derivatives such as carboxymethylcellulose, hydroxyethylcellulose, and hydroxypropylmethylcellulose; conjugated diene type copolymer latexes such as SBR latex, NBR latex, and methyl methacrylate-butadiene copolymer latex; functional group-modified polymer latex; vinyl type copolymer latex such as ethylene-vinyl acetate copolymer latex; polyvinylpyrrolidone; and acrylate copolymers. The binder may be used singly or in combination of two or more thereof.

The alumina hydrate and the binder may be mixed in a ratio ranging preferably from 1:1 to 30:1, more preferably from 5:1 to 25:1. With the amount of the binder less than the above range, the mechanical strength of the ink-receiving layer tends to be insufficient, whereas with the amount of the binder more than the above range, the pore volume tends to be insufficient, resulting in lower ink absorbency.

The coating liquid for forming the ink-receiving layer may contain, in addition to the alumina hydrate and the binder, an additive such as a dispersing agent, a thickening agent, a pH controller, a lubricant, a fluidity modifier, a surfactant, a defoaming agent, a water resistance-imparting agent, a releasing agent, a fluorescent whitener, and a U/V absorber.

The alumina hydrate is applied onto the substrate preferably in an amount not less than 10 g/m$^2$ for the dye fixability: preferably in the range from 30 to 50 g/m$^2$ for the substrate having no ink absorbency, and in the range of from 20 to 40 g/m$^2$ for the substrate having ink absorbency.

The methods for coating and drying are not specially limited. The alumina hydrate and the binder may be baked, if necessary, to increase the crosslinking strength of the binder, increase the mechanical strength of the ink-receiving layer, and improve the surface gloss of the alumina hydrate layer.

The printed matter is obtained in the present invention by applying ink to the ink-receiving layer of the recording medium, and subsequently, as necessary, making nonporous (transparent) the porous outermost layer containing particulate thermoplastic resin.

The ink preferably is applied onto the recording medium by an ink-jet system of ejecting ink droplets in view of expediency. Of the ink-jet systems, a bubble-jet system is employed in which ink droplets are formed by action of thermal energy to the ink in view of the possibility of high speed printing and fine printing.

The porous layer containing the thermoplastic resin particles preferably is made nonporous by heat treatment, thereby improving weatherability such as water resistance and light fastness, the printed image is made glossy, and the printed matter is made storable for a long term. The heating temperature therefor is not lower than the flow temperature of the particulate thermoplastic resin, preferably not lower than the minimum film-forming temperature (MFT). The heating temperature depends on the kind of the thermoplastic resin, ranging preferably from 70° C. to 180° C. in consideration of the surface properties after the non-porosity treatment.

The present invention is described more specifically below by reference to examples without limiting the invention.

EXAMPLE 1

In a manner of the process disclosed in U.S. Pat. No. 4,242,271, aluminum octoxide was synthesized and was hydrolyzed and peptized to obtain a colloidal sol of alumina hydrate. The colloidal sol was concentrated to obtain a solution of 15% by weight.

Separately, polyvinyl alcohol (trade name: PVA 117, produced by Kuraray Co., Ltd.) was dissolved in a deionized water at a concentration of 10% by weight.

The above two solutions were mixed and stirred to obtain a liquid dispersion containing the alumina hydrate and the polyvinyl alcohol in a solid matter ratio of 10:1 by weight. This liquid dispersion was applied onto a polyethylene terephthalate film by die coating to form an alumina hydrate-containing porous layer. The porous layer had a thickness of about 40 $\mu$m.

On this porous layer, a vinyl chloride-vinyl acetate-acrylate type latex of a solid matter content of 15% (mean particle diameter: 0.6 $\mu$m, fraction of the particles of 0.12 $\mu$m or smaller: 7.5%, Tg: 65° C., and MFT: 127° C.) was applied by a bar coater, and the applied latex was dried at 65° C. to obtain a porous latex layer about 5 $\mu$m thick to complete the recording medium of the present invention. By SEM observation of the formed latex layer, the latex particles were confirmed to be fusion-bonded partially together.

On the recording medium, an image was formed by an ink-jet printer (trade name: BJC 610JW, manufactured by Canon K. K.) with inks having the composition shown below, and the recording medium was heat-treated at 140° C. to make the latex layer nonporous to obtain a printed matter of photograph picture quality.

Ink Composition

| | |
|---|---|
| Dye (Y, M, C, or Bk below) | 3 wt parts |
| Glycerin | 7 wt parts |
| Thiodiglycol | 7 wt parts |
| Water | 83 wt parts |

Dye:
Y: C.I. Direct Yellow 86
M: C.I. Acid Red 35
C: C.I. Direct Blue 199
Bk: C.I. Food Black 2

This printed matter was evaluated for optical density, weatherability, and printed dot state. The recording medium was evaluated for scratch resistance, and ink absorbency. Table 1 shows the results.

(a) Optical Density:

The optical density was evaluated by means of a MacBeth Reflectodensitometer RD-918.

(b) Weatherability:

The printed matter was left outdoors for 8 days, and the change of the image was observed. The symbol "A" denotes the image excellent in light fastness, water resistance, humidity resistance, and acid resistance without deterioration of the image; the symbol "B" denotes the image showing slight deterioration without practical problems; and the symbol "C" denotes significant deterioration of the image.

(c) Scratch Resistance:

The recording medium was rubbed with a weight of 800 g placed thereon. The symbol "A" denotes that the recording medium was not scratched; the symbol "B" denotes that the recording medium was slightly scratched; the symbol "C" denotes that the recording medium was scratched in large numbers.

(d) Ink Absorbency:

Bleeding between the colors of the printed image, especially, at the border between synthetic color portions where inks are applied in a larger amount, and beading were observed visually. The symbol "A" denotes no bleeding and no beading; the symbol "B" denotes slight bleeding and slight beading with no practical problem; and the symbol "C" denotes significant bleeding and significant beading.

(e) Printed Dot State:

The printed dots were observed visually in comparison with a reference recording medium having no porous outermost layer containing the particulate thermoplastic resin. The symbol "A" denotes that the dots have a large diameter and are in a precise circle shape in comparison with the reference; the symbol "B" denotes that the dots are a little smaller or slightly deformed without a practical problem; and the symbol "C" denotes that the dots are obviously smaller in size, or deformed, or the color is nonuniform.

EXAMPLE 2

A porous layer (ink-receiving layer) was formed in the same manner as in Example 1. On the porous layer, a styrene type latex (trade name: LX303, produced by Nippon Zeon K. K., Tg: 100° C., minimum film-forming temperature: 120° C.) containing PVA at a solid matter content of 3% was applied by a bar coater. The applied latex was dried at 50° C., and heat-treated at 103° C. for 5 seconds to form a porous latex layer about 5 μm thick. Thus the recording medium of the present invention was completed. By SEM observation of the formed latex layer, it was confirmed that the latex particles were fusion-bonded partially together. The void ratio at the latex layer surface was 15%.

Printing was conducted on the resulting recording medium in the same manner as in Example 1. The evaluation results are shown in Table 1.

COMPARATIVE EXAMPLE 1

A recording medium was prepared and printing was conducted in the same manner as in Example 1 except that the latex used in Example 1 was replaced by an SBR type latex (trade name: LX382, produced by Nippon Zeon K. K.). The evaluation results are shown in Table 1.

TABLE 1

| | Example 1 | Example 2 | Comparative example 1 |
|---|---|---|---|
| Latex ΔE | 11.3 | 12.0 | 32.5 |
| Density (O.D.) | | | |
| Black | 1.8 | 1.9 | 1.9 |
| Yellow | 1.7 | 1.7 | 1.8 |
| Magenta | 2.2 | 2.2 | 2.2 |
| Cyan | 2.4 | 2.4 | 2.3 |
| Ink absorbency | B | B | B |
| Printed dot state | B | B | B |
| Weatherability | A | A | C |
| Scratch resistance | A | A | C |

EXAMPLES 3–6

A recording medium was prepared and printing was conducted in each Example in the same manner as in Example 1 except that the latex used in Example 1 was replaced by the one shown in Table 2. The evaluation results are shown in Table 2. All of the material shown in Table 2 had a minimum film-forming temperature of not lower than 50° C. and higher by 10° C. or more than the glass transition temperature.

The void ratios of the outermost layer in Examples 3, 4, 5, and 6 were respectively 15%, 40%, 18%, and 17%.

TABLE 2

| Latex | Example 3 Styrene-acryl type*1 | Example 4 Vinyl chloride type*2 | Example 5 Acrylate ester copoly-mer type*3 | Example 6 Vinyl chloride acrylate copolymer type*4 |
|---|---|---|---|---|
| Latex ΔE | 18.2 | 16.5 | 10.5 | 12.3 |
| Density (O.D.) | | | | |
| Black | 1.5 | 1.8 | 2.0 | 1.8 |
| Yellow | 1.5 | 1.6 | 2.0 | 1.7 |
| Magenta | 1.7 | 2.1 | 2.2 | 2.1 |
| Cyan | 1.5 | 2.2 | 2.2 | 2.2 |
| Ink absorbency | B | B | B | B |
| Printed dot state | B | B | B | B |
| Weatherability | B | A | A | A |
| Scratch resistance | B | B | B | B |

*1SX865(B), Japan Synthetic Rubber Co.
*2G151, Nippon Zeon Co.
*3Cebian A4620, Daicel Chemical Industries
*4Vinybran 683, Nisshin Kagaku Kogyo

EXAMPLE 7

Alumina hydrate (sol) was prepared by hydrolyzing and peptizing aluminum isoproxide.

A porous layer was formed in the same manner as in Example 1, except that the above alumina hydrate sol was used. The porous layer had a thickness of about 40 μm. On this porous layer, a porous latex layer was formed in a thickness of about 5 μm in the same manner as in Example 1 to obtain a recording medium of the present invention.

On this recording medium, an image was formed in the same manner as in Example 1, and then the latex layer was made nonporous to obtain a printed matter of photograph picture quality. The evaluation results 5 are shown in Table 3.

TABLE 3

| | Example 7 |
|---|---|
| Density (O.D.) | |
| Black | 1.7 |
| Yellow | 1.6 |
| Magenta | 2.2 |
| Cyan | 2.3 |
| Ink absorbency | A–B |
| Printed dot state | B |
| Weatherability | A |
| Scratch resistance | A |

EXAMPLE 8

A base paper sheet composed of wood pulp and a filler was employed. This paper sheet had a basis weight of 180 g/m$^2$, a Stöckigt sizing degree of 230 seconds, and a Bekk smoothness degree of 355 seconds. On this base paper sheet, was applied a composition comprised of 105 parts of barium sulfate (mean particle diameter: 0.7 μm), 10 parts of gelatin, 3.5 parts of polyethylene glycol, and 0.5 parts of chrome alum (parts are based on weight) in a coating amount of 30 g/m$^2$. The coated paper sheet was super-calendered for surface smoothening to obtain a surface smoothness of 430 seconds.

On this base sheet, an alumina hydrate-containing porous layer was formed in a thickness of about 30 μm.

Further, on this porous layer, a porous latex layer was formed with the same material as used in Example 1 but with a mean particle diameter of 0.7 μm to obtain a recording medium of the present invention.

On this recording medium, an image was formed in the same manner as in Example 1, and then the latex layer was made nonporous to obtain a printed matter of photograph picture quality. The evaluation results are shown in Table 4.

TABLE 4

| | Example 8 |
|---|---|
| Density (O.D.) | |
| Black | 2.1 |
| Yellow | 1.8 |
| Magenta | 2.3 |
| Cyan | 2.4 |
| Ink absorbency | A |
| Printed dot state | A |

TABLE 4-continued

| | Example 8 |
|---|---|
| Weatherability | A |
| Scratch resistance | A |

EXAMPLE 9

A sheet having an alumina hydrate-containing porous layer formed thereon was prepared in the same manner as in Example 8 except that the base paper sheet had a basis weight of 140 g/m$^2$, a Stöckigt sizing degree of 230 seconds, and a Bekk smoothness degree of 330 seconds. Then onto the back face of the base sheet (reverse to the porous layer-coated face), a 5% polyvinyl alcohol solution was applied with a bar coater. On the surface of the porous layer of the front side, a porous latex layer was formed in the same manner as in Example 1.

An image was formed on this recording medium in the same manner as in Example 1. The planarity of the recording medium was kept well. The printed matter was made non-porous in the same manner as in Example 1. Table 5 shows the results.

TABLE 5

| | Example 9 |
|---|---|
| Density (O.D.) | |
| Black | 2.1 |
| Yellow | 1.8 |
| Magenta | 2.3 |
| cyan | 2.4 |
| Ink absorbency | A |
| Printed dot state | A |
| Weatherability | A |
| Scratch resistance | A |

The present invention provides a novel recording medium that does not discolor during long term storage, has excellent ink absorbency, and has excellent scratch resistance.

The present invention also provides a recording method that gives printed matters of high image density, high gloss, and high quality comparable with a silver salt photograph.

What is claimed is:

1. A recording medium comprising a porous outermost layer on a substrate, an ink-receiving layer being provided between said substrate and said outermost layer, said ink-receiving layer comprising at least as much pigment as any other component by weight, and being porous, said porous outermost layer containing a particulate thermoplastic resin, said particulate thermoplastic resin exhibiting a ΔE value of not higher than 20 after light exposure, wherein ΔE is an index of the degree of photo-deterioration of a resin, expressed in color difference caused by light exposure, and is calculated on the basis of JIS Z 8730 according to the equation below:

$$\Delta E=[(L-L_0)^2+(a-a_0)^2+(b-b_0)^2]^{1/2}$$

where L and $L_0$ are levels of the lightness; a and $a_0$ are levels of the hue; b and $b_0$ are levels of the saturation; $L_0$, $a_0$, and $b_0$ are measured values before the light exposure; and L, a and b are measured values after a 200-hour exposure; and wherein the difference of glass transition temperature of said particulate thermoplastic resin from minimum film-forming temperature thereof is not less than 10° C., and the minimum film-forming temperature is not lower than 50° C., wherein said particulate thermoplastic resin comprises latex particles comprised of a copolymer formed from three or more monomers of vinyl chloride-vinyl acetate-acrylate, and wherein particles of said particulate thermoplastic resin are partially fusion-bonded together.

2. The recording medium according to claim 1, wherein said pigment is alumina hydrate.

3. An ink-jet recording method comprising allowing ink droplets to fly onto and adhere to a recording medium set forth in claim 1.

4. An ink-jet recording method comprising allowing ink droplets to fly onto and adhere to a recording medium set forth in claim 1, and subsequently heating the recording medium.

5. A process for producing the recording medium set forth in claim 1, comprising forming a porous outermost layer by heat treatment at a temperature of not lower than the glass transition temperature of said particulate thermoplastic resin, but not higher than the minimum film-forming temperature thereof.

6. The recording medium according to claim 1, wherein said partial fusion-bonding is achieved by heat-treating the thermoplastic resin at a temperature ranging from the glass transition temperature of the thermoplastic resin to the minimum film-forming temperature thereof.

7. The recording medium according to claim 1, wherein said porous outermost layer has surface voids in a surface void ratio ranging from 10% to 50%.

* * * * *

UNITED STATES PATENT AND TRADEMARK OFFICE

CERTIFICATE OF CORRECTION

PATENT NO. : 6,670,000 B1
DATED : December 30, 2003
INVENTOR(S) : Katsutoshi Misuda et al.

It is certified that error appears in the above-identified patent and that said Letters Patent is hereby corrected as shown below:

Title page,
Item [*] Notice, “143 days” should read -- 0 days --.

Column 1,
Line 28, “output” should read -- to output --.
Line 32, “speed. Correspond-” should read -- speed, --.
Line 33, “ingly image” should read -- finer image --.

Column 5,
Line 30, “an” should be deleted.

Column 6,
Lines 43 and 44, “derivative” should read -- derivatives --.

Signed and Sealed this

First Day of June, 2004

JON W. DUDAS
*Acting Director of the United States Patent and Trademark Office*